United States Patent [19]

Blaak et al.

[11] Patent Number: 4,510,863

[45] Date of Patent: Apr. 16, 1985

[54] SYSTEM ADAPTED TO DISTRIBUTE A VISCOUS SUBSTANCE

[75] Inventors: Cornelis Blaak, Boxmeer; Gerardus H. van Mondfrans, Sambeek, both of Netherlands

[73] Assignee: Stork Brabant B.V., Netherlands

[21] Appl. No.: 480,396

[22] Filed: Mar. 30, 1983

[30] Foreign Application Priority Data

Apr. 8, 1982 [NL] Netherlands ..... 8201505

[51] Int. Cl.[3] ..... B41L 13/18

[52] U.S. Cl. ..... 101/119; 222/145

[58] Field of Search ..... 101/119, 120, 116, 117, 101/123, 124; 222/145

[56] References Cited

U.S. PATENT DOCUMENTS

| | | | |
|---|---|---|---|
| 2,347,717 | 5/1944 | Staege | 162/338 |
| 2,869,436 | 1/1959 | Stewart | 162/259 |
| 4,085,672 | 4/1978 | Grosart | 101/120 |
| 4,138,943 | 2/1979 | Mitter | 101/120 |
| 4,299,164 | 11/1981 | Jonkers | 101/119 |

FOREIGN PATENT DOCUMENTS

| | | | |
|---|---|---|---|
| 0047559 | 3/1982 | European Pat. Off. | 101/120 |
| 0047907 | 3/1982 | European Pat. Off. | 101/120 |
| 2174249 | 3/1973 | France . | |
| 7302911 | 9/1973 | Netherlands . | |
| 8201505 | 9/1973 | Netherlands . | |

*Primary Examiner*—Edgar S. Burr
*Assistant Examiner*—M. J. Hirabayashi
*Attorney, Agent, or Firm*—Lucas & Just

[57] ABSTRACT

An apparatus to be used in the screen-printing art distributes viscous printing substance and comprises first and second distribution passages extending lengthwise along an elongated common passage. The distribution passages have first ends in proximity to each other and second ends in proximity to each other. Feed means supply the viscous substance to each distribution passage, each distribution passage having, along its length, a tapered outflow opening. The tapered outflow opening of the first distribution passage increases from the first end to the second end thereof and the tapered outflow opening of the second distribution passage increases from the second end to the first end thereof. The two distribution passages work together to evenly distribute the viscous substance to the elongated common passage.

11 Claims, 7 Drawing Figures

SYSTEM ADAPTED TO DISTRIBUTE A VISCOUS SUBSTANCE

BACKGROUND OF THE INVENTION

1. Field of the Invention

The present invention relates to an apparatus adapted to evenly fill an elongate collecting space with a viscous substance, said substance being dispensed again along one elongate side of the space, and comprising a distributing pipe provided parallel to the space and having a feed means connection and an outflow surface for the substance provided along the entire length of the distributing pipe.

2. Description of the Prior Art

An apparatus of this type has been used in the art, to wit in application techniques for obtaining a proper, even distribution of a coating, impregnating, finishing or printing substance across the width of a substrate to be treated. U.S. patent application Ser. No. 501,967 filed June 10, 1983, which was a continuation of Ser. No. 299,550 filed on Sept. 4, 1981 now abandoned in the name of Cornelis BLAAK describes for the rotary printing technique a special use of such a distributing system in conjunction with a gap-type squeegee and wherein said elongate collecting space is formed by two thin, flexible metal blades spaced from each other at some distance.

In rotary printing and coating techniques it is important that the substance used for printing or coating to be distributed as evenly as possible in the stencil before the squeegee.

In this connection it has often been possible to absorb the irregularities, inevitably occurring in the feed system or in the dispensing of the substance, (for example, in case of a strongly asymmetrical design), by means of the amount of substance building up before the squeegee and indicated by the designation "roll". By properly defining the shape or configuration of the outflow surface provided along the entire length of the distributing pipe, there will be formed, within wide viscosity limits of the substance, a "roll" such, that an even printing or coating is achieved. Nevertheless, it is advisable to be continually alert when using the conventional distributing systems, especially when during the coating or printing process there occur changes in the viscosity, for example, due to the varying temperature.

SUMMARY OF THE INVENTION

It is a main object of the present invention to provide an apparatus ensuring an almost constant, even distribution of the substance over the collecting space so that the operation aimed at (printing, coating, impregnating or finishing) proceeds in a uniform manner and the product obtained corresponds to the result intended.

This object is attained according to the invention in that there are provided two substantially identical distributing pipes extending parallel to each other along the entire length of the collecting space, each of them being provided with a feed means connection at one end opposite each other, the shape or configuration of the substance outflow surface of both distributing pipes being reverse to one another.

As a result of these measures, in the event of a changing viscosity of the substance, there occur changes in the delivery of the substance via the outflow surfaces of the two distributing pipes. These changes operate in a compensating manner with respect to each other, thus ensuring that under any circumstances the final result shows the great uniformity as desired.

In a particular embodiment, the outflow surface of a distributing pipe is formed by a passage gap converging widthwise and bounded on at least one elongate side by a strip, to be mounted adjustably and likewise provided along the entire length of the passage gap. Instead of using a varying pattern of holes, this embodiment utilizes a combination of two passage gaps changing in opposite directions, whereby it is possible to safeguard the even distribution as intended.

The apparatus so far described in addition affords the possibility of using a width limitation, without obstructing the intended uniform distribution of the substance. According to the invention, this object is attained in that the outflow surface of each distributing pipe communicates with a common passage leading to the collecting space and in that at both extremities of said passage there is provided a slidable closing member, so that the dimension of the passage in longitudinal direction can be determined thereby, for example, in relation to the width of the substrate to be printed or to be coated.

With the embodiment of the present apparatus in the form of a gap-type squeegee consisting of two parallel blades, it is possible to obtain a very compact construction provided that the distributing pipes, the supply conduits, the feed pipe and the strips are contained within a common housing and due to the squeegee blades being located in two profiled beams which fit against and are fixable to the housing and in between which, in the assembled condition, the passage for the substance is formed.

The features of the present invention which are believed to be novel are set forth with particularity in the appended claims.

Other claims and many of the attendant advantages will be more readily appreciated as the same becomes better understood by reference to the following detailed description and considered in connection with the accompanying drawings in which like reference symbols designate like parts throughout the figures.

DESCRIPTION OF THE PREFERRED EMBODIMENTS

The earlier U.S. patent application Ser. No. 288,550 mentioned hereinbefore discloses an apparatus for evenly filling an elongate collecting space with a viscous substance. Said known apparatus may be considered to be the state of the art and forms the starting point for the present apparatus which distinguishes itself on several points as compared to said state of the art.

Figure 1:
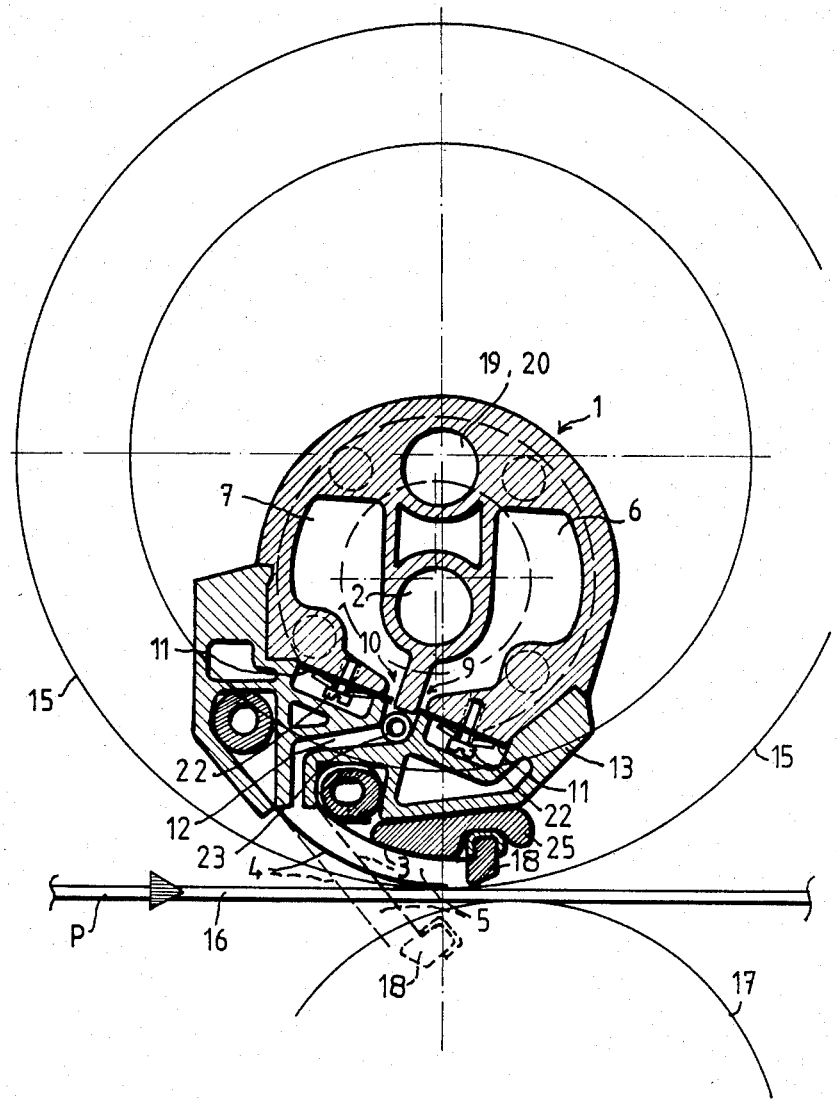
FIG. 1 is a cross-sectional view over a first embodiment of the device being in the operative position, in the interior of a cylindrical stencil.

In a manner known per se, the present apparatus is comprised of a housing 1 internally provided with a feed pipe 2 for substance to be applied (FIG. 1). Said pipe 2 projects at one of the extremities of the apparatus (FIG. 2) enabling same to be connected to a feed pump (not shown) for said substance. In addition, the housing 1 carries two parallel blades 3 and 4 jointly enclosing an elongate collecting space 5. This space directly communicates with the feed pipe 2 located within the housing 1 (FIGS. 1, 4).

Figures 2, 3A:
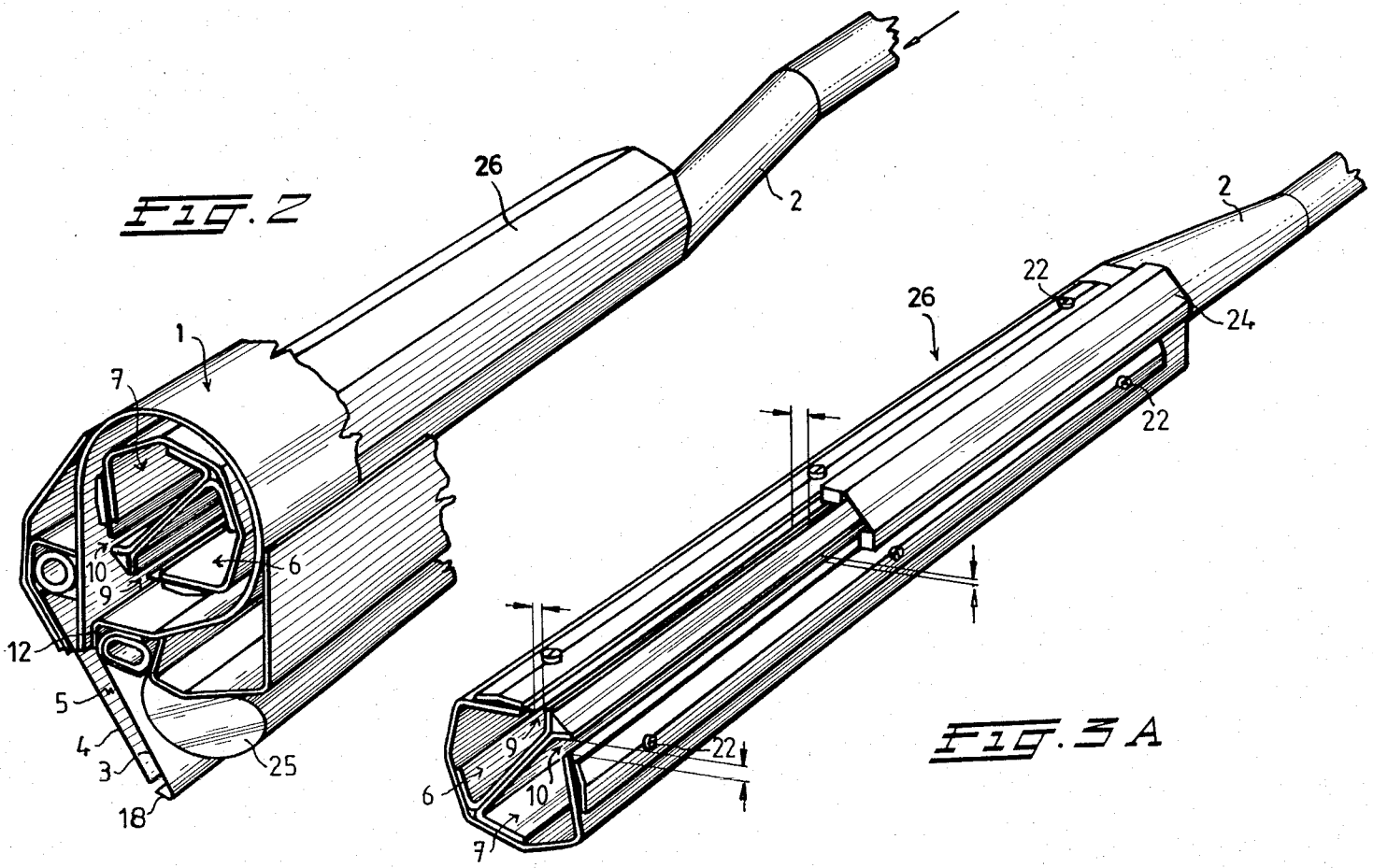
FIG. 2 is a perspective view of a portion of a second embodiment of a squeegee device being in the inoperative position.
FIG. 3A is a perspective view of the distribution element from the device of FIG. 2, on a somewhat enlarged scale.
Figure 3B:
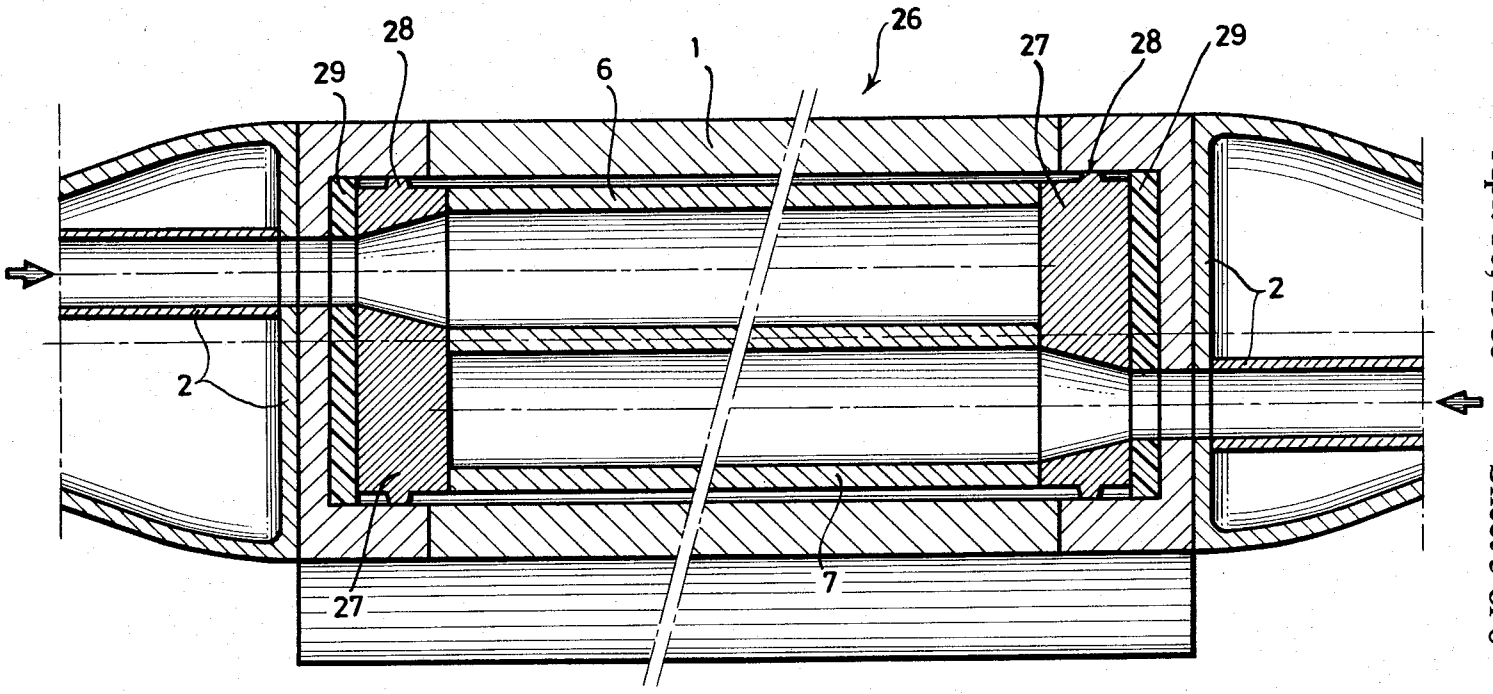
FIG. 3B is a longitudinal section through another embodiment of a distribution element.
Figure 4:
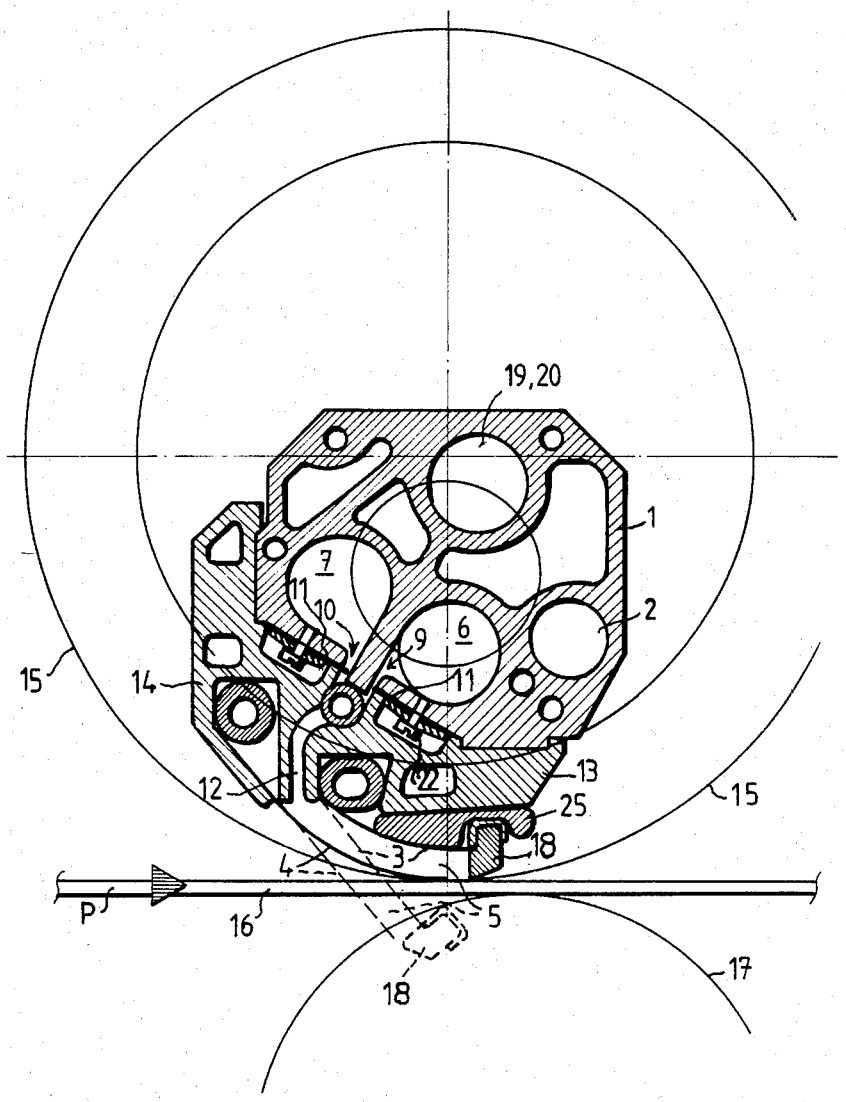
FIG. 4 is a cross-sectional view similar to FIG. 1, of a modified embodiment of the respective device.

The present apparatus distinguishes itself from the state of the art in that, parallel to one another, there are provided two substantially identical distributing pipes (FIGS. 2 and 3A, 3B) or voids 6 and 7 (FIGS. 1 and 4). Said pipes or voids extend along the entire length of the collecting space 5 and are each provided with a feed means connection 8 (FIG. 5) at one extremity, located opposite in a manner reverse with respect to one another. Said distributing pipes or voids 6 and 7 are each provided with an outflow surface 9 and 10, respectively, extending along their entire length. Such an outflow surface may consist of a series of holes having increasing diameters but in the present case said surfaces 9 and 10 are formed by a gap converging widthwise and bounded on at least one elongate side by a strip 11 to be mounted adjustably and likewise being provided along the entire length of the gap. The position of each strip in the gap is such that the respective shapes or configurations of the outflow surfaces 9 and 10 of the two distributing pipes 6 and 7, are disposed opposite to one another. The latter aspect is best seen in FIG. 3A, and will be further explained hereinafter with reference to FIG. 6.

The outflow surface 9, 10 of each distributing pipe or void 6, 7 communicates with a common passage 12 leading to the collecting space 5 bounded by the blades 3 and 4. The squeegee blades are located in two profiled beams 13 and 14 which fit against and are fixable to the housing 1. As seen in FIGS. 1 and 4, the common passage 12 for the substance is formed between said profiled beams when in the assembled condition.

FIGS. 1 and 4 illustrate the squeegee device in an operative position inside a cylindrical screen 15. The outside of this cylindrical screen is in contact with a substrate which, whether or not in combination with an endless supporting belt, is referenced 16. This web or belt 16 travels in the direction of the arrow P. As is customary whein using a cylindrical screen, a support roller 17 is provided on the other side of the web or belt 16. In the operative position of the squeegee device, the two squeegee blades 3 and 4 are curved. When the squeegee device is not in contact with the screen the blades 3 and 4 are flat (see the dotted lines).

The trailing blade 3 of the two blades 3 and 4 is provided with a thickened squeegee edge 18 which, in the inoperative position of the device (FIG. 2), almost seals off the space 5 between the blades 3 and 4 then being in their flat condition, while in the operative position of the device (FIGS. 1 and 4), when the blades 3 and 4 are curved, the thickened edge 18 performs the actual squeegee operation.

Figure 6:
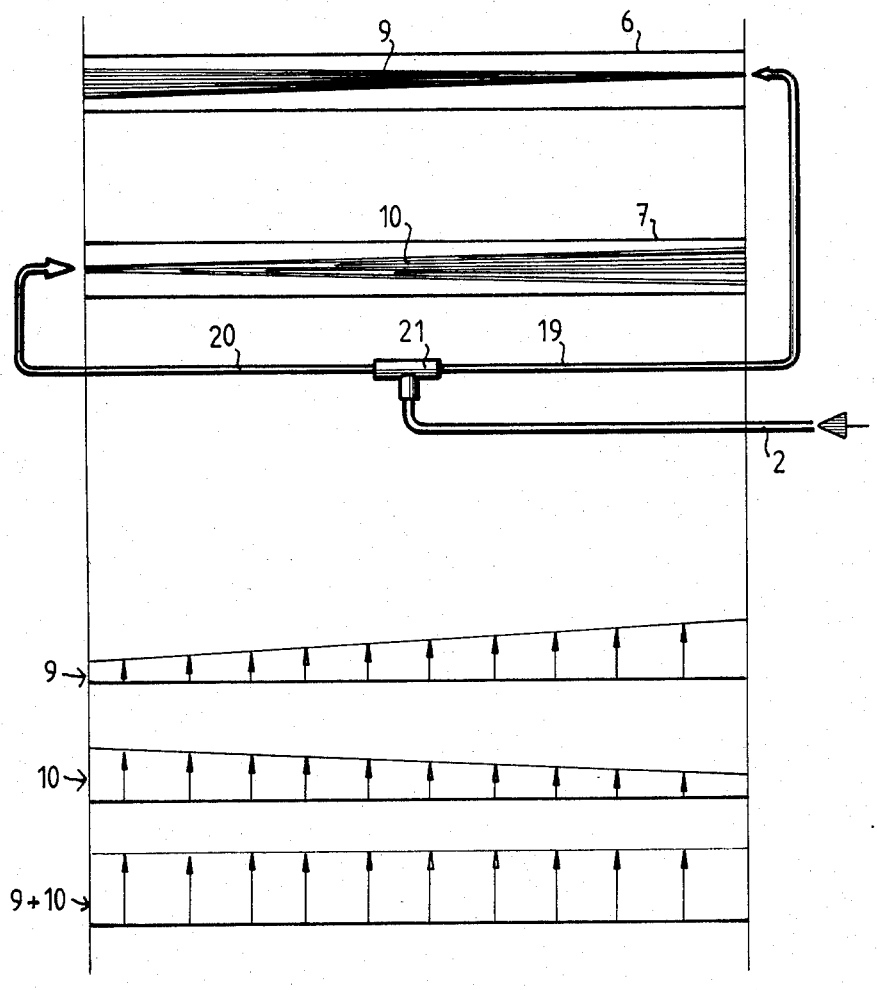
FIG. 6 shows schematically the effect of the invention.

The significance of the outflow surfaces 9 and 10 associated with the distributing pipes or voids 6 and 7 and having a configuration reverse with respect to one another, is elucidated referring to FIG. 6. In this figure the outflow surfaces have the shape of a gap, the width of which increasing as considered in the initial direction of travel of the substance. The use of a gap instead of a pattern of holes is beneficial in processing a foamed substance, as in this manner there will occur the least possible disturbance in the foam structure. The lower part of the figure illustrates the distribution of the substance output for the two gap-shaped outflow surfaces 9 and 10, from which it is evident that the total output arriving in the common passage 12 is uniform and all possible variations in consistency and supply of the substance are compensated by using the reverse configuration of the gaps.

The upper part the figure (see also FIG. 5) illustrates that the feed means connection 8 of each distributing pipe or void 6, 7 communicates with an end of the substance supply conduits 19 and 20, and that the other ends of said supply conduits join one another in the central region 21 of the distributing pipes. At the latter point each supply conduit 19 and 20 is connected to the common supply conduit or pipe 2. In this connection it should be noted that a change from one substance to another substance having a totally different viscosity or operating range (e.g. from low viscous finishing liquids to a viscous coating paste) will cause the shape of the outflow surfaces 9 and 10, to be adjusted i.e. a presetting of the strips 11 will have to be performed.

To this end, adjusting bolts 22 are provided (FIGS. 1 and 4), said bolts being accessible after removal of the profiled beams 13 and 14, or after removal of the distribution element 26 (FIG. 3A).

An additional advantage of using the two distributing pipes 6 and 7 consists in the possibility of obtaining in an easy manner a width adjustment of the substance flowing to the common passage 12 and the space 5.

Figure 5:
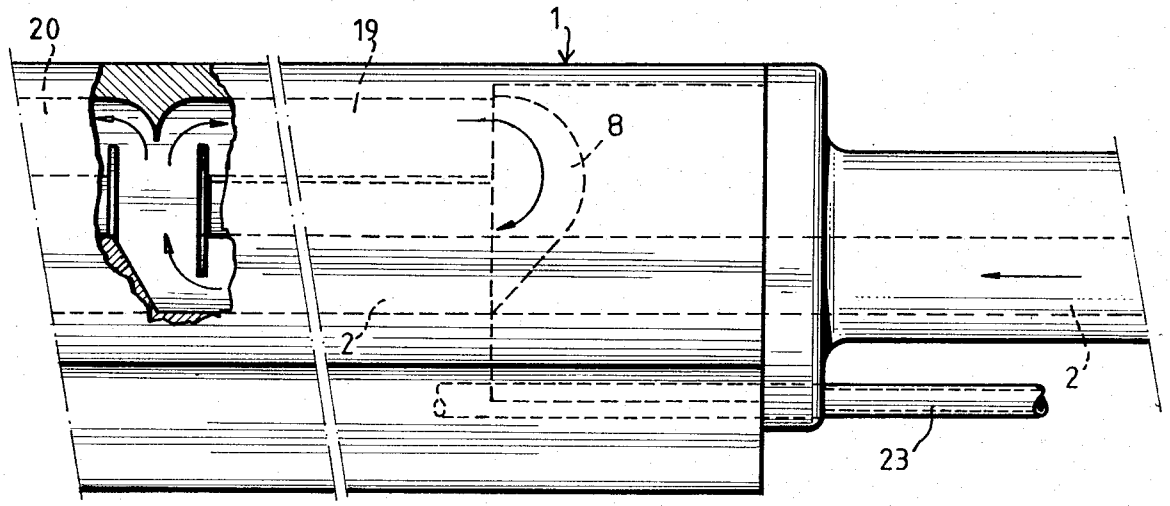
FIG. 5 is a schematic, at the same time partial longitudinal sectional view taken on line V—V in FIG. 1.

In FIGS. 1, 4 and 5 an elastic tubular closing member 23 is inserted on both sides into the passage 12 to a specific extent and which ensures the intended closing off near the two extremities of said passage. The uniformity in the supply of the substance is not affected by this width adjustment (as is apparent from the lower part of FIG. 6). It has been found that it is then possible to effect an adjustment between a maximum value of 3200 mm and a minimum value of 1200 mm without any problems occurring. FIG. 3A illustrates that the width adjustment for the embodiment of the squeegee device as per FIG. 2 can be obtained by means of a slidable cover strip 24.

FIGS. 1 and 4 also illustrate that, in a manner known per se from the aforementioned earlier U.S. patent application Ser. No. 299,550 an expandable bag 25 is employed for determining the squeegee pressure via the thickened squeegee edge 18. The power keeping this squeegee edge in contact with the cylindrical screen 15 influences in particular the so-called penetration, which is of special importance when printing fabrics.

Referring now to FIG. 3B in the illustrated embodiment of the distribution element 26 the pipes 6 and 7 are mounted in end disks 27 provided with a bead 28 fitting into the interior of the element 26. By these means the distributing pipes 6 and 7 remain free of any stress caused by deformation of the element 26 which occurs unavoidably under the load of the squeegee blades 3 and 4. The pipes 6 and 7 together with the end disks 27 are clamped between two feed pipes 2, with a soft rubber plate 29 added in between. In this embodiment the exact shape of the outflow surfaces 9 and 10 will not be influenced by any load on the distribution element 26.

It should be noted that the present squeegee device (gap-type squeegee) as described, is of particular importance when using the system described with reference to FIGS. 8 and 9 of the aforementioned earlier U.S. patent application Ser. No. 299,550. In the latter case it concerns an entirely closed system for feeding the substance, wherein the quantity taken from the space 5 is equal to the supply through the pipe 2. This results in a flow of substance which is variable and which is adjustable as a function of the operating speed of the machine, the output, the covering percentage and the width of the substrate, so enabling different flow-through and outflow resistances. In known squeegee devices comprising known distributing systems the latter caused frequent corrections to be made in the shape or configuration of the outflow surface of the relative distributing pipe.

The users of the type of apparatus, according to the present invention may, however, always rest assured, in terms of process control engineering that, with any amount of flow and viscosity of the substance, the quantity applied to the substrate be evenly distributed across the width of this substrate.

Processing foamed substances for printing and coating as well as for finishing liquids require, in view of flow control considerations, the use of a uniform outflow surface so as to prevent streaks occurring in the printing result. Said streak forming is brought about, on the one hand, from foam breakdown at high shearing forces, caused by too great a pressure drop, and, on the other hand, from an insufficiently uniform supply of the substance to be applied to the substrate. These deficiencies, which sometimes occur in apparatus according to the state of the art, are completely eliminated in the present apparatus.

What is claimed is:

1. Apparatus for evenly distributing a viscous substance into an elongated common passage comprising:

(a) first and second distribution passages extending lengthwise along said common passage;

(b) each said distribution passage having a first end and a second end, the distribution passages being aligned with their first ends in proximity to each other and with their second ends in proximity to each other;

(c) feed means for supplying viscous substance to each said distribution passage, said feed means supplying said first distribution passage at said first end thereof and said feed means supplying said second distribution passage at said second end thereof;

(d) each said distribution passage having an outflow opening tapered along the length of the distribution passage, the tapered outflow opening of the first distribution passage increasing from the first end to the second end thereof and the tapered outflow opening of the second distribution passage increasing from the second end to the first end thereof.

2. Apparatus of claim 1 further comprising means to adjust the size of each said tapered outflow opening, said means being adjustably mounted strips.

3. Apparatus of claim 1 wherein said distribution passages are in the form of pipes.

4. Apparatus of claim 3 wherein said feed means is a common supply pipe from which a first and a second supply pipe branch, said first supply pipe supplying said first distribution pipe and said second supply pipe supplying said second distribution pipe.

5. Apparatus according to claim 3 wherein said common passage is defined by two profile beams, a lead and a trail profile beam, said lead profile beam being attached to said first distribution pipe and said trail profile beam being attached to said second distribution pipe, and further comprising a lead squeegee blade and a trail squeegee blade, said lead profile beam housing said lead squeegee blade, and said trail profile beam housing said trail squeegee blade.

6. Apparatus according to claim 5, wherein said trail blade is provided with a thickened edge.

7. Apparatus according to claim 3, further comprising end disks and a distribution element, both said distribution pipes being freely mounted with respect to said distribution element by means of said end disks said disks being fitted with an annular bead to allow said distribution pipes to move freely within said distribution element.

8. Apparatus of claim 1 further comprising slidable closing members at each end of said common passage for closing off and adjusting said common passage in a lengthwise direction.

9. In a squeegee bar apparatus for distributing a viscous substance onto a surface through an elongated common passage:

(a) first and second distribution passages extending lengthwise along said common passage;

(b) each said distribution passage having a first end and a second end, the distribution passages being aligned with their first ends in proximity to each other and with their second ends in proximity to each other;

(c) feed means for supplying viscous substance to each said distribution passage, said feed means supplying said first distribution passage at said first end thereof and said feed means supplying said second distribution passage at said second end thereof;

(d) each said distribution passage having an outflow opening tapered along the length of the distribution passage, the tapered outflow opening of the first distribution passage increasing from the first end to the second end thereof and the tapered outflow opening of the second distribution passage increasing from the second end to the first end thereof;

(e) said common passage being defined by two profile beams, a lead and a trail profile beam, said lead profile beam being attached to said first distribution passage and said trail profile beam being attached to said second distribution passage, and further comprising a lead squeegee blade and a trail squeegee blade, said lead profile beam housing said lead squeegee blade, and said trail profile beam housing said trail squeegee blade.

10. The squeegee bar of claim 9 further comprising means to adjust the size of each said tapered outflow opening, said means being adjustably mounted strips.

11. The squeegee bar of claim 9 wherein said tapered outflow opening consists of a series of holes, said holes of the first distribution passage increasing in diameter from the first end to the second end thereof and said holes of said second distribution passage increasing in diameter from the second and to the first end thereof.

* * * * *